US012565891B2

(12) United States Patent
Katayama et al.

(10) Patent No.: US 12,565,891 B2
(45) Date of Patent: Mar. 3, 2026

(54) COMPRESSOR UNIT AND REFRIGERATION APPARATUS WITH REDUCED VIBRATIONS

(71) Applicant: DAIKIN INDUSTRIES, LTD., Osaka (JP)

(72) Inventors: Tatsuya Katayama, Osaka (JP); Daiki Kikutake, Osaka (JP); Shota Kamei, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 112 days.

(21) Appl. No.: 18/612,559

(22) Filed: Mar. 21, 2024

(65) Prior Publication Data

US 2024/0263631 A1 Aug. 8, 2024

Related U.S. Application Data

(63) Continuation of application No. PCT/JP2022/030262, filed on Aug. 8, 2022.

(30) Foreign Application Priority Data

Sep. 30, 2021 (JP) ..... 2021-161444

(51) Int. Cl.
*F04C 29/06* (2006.01)
*F04C 18/356* (2006.01)

(52) U.S. Cl.
CPC ..... *F04C 29/06* (2013.01); *F04C 18/356* (2013.01); *F04C 18/3564* (2013.01);
(Continued)

(58) Field of Classification Search
CPC .... F04C 29/06; F04C 18/356; F04C 18/3564; F04C 2240/804; F04C 2270/12; F04C 2270/15
See application file for complete search history.

(56) References Cited

FOREIGN PATENT DOCUMENTS

| | | | | |
|---|---|---|---|---|
| CA | 2655762 C | * | 5/2011 | ..... F04C 29/068 |
| EP | 3 364 130 A1 | | 8/2018 | |
| JP | 2001-317479 A | | 11/2001 | |

OTHER PUBLICATIONS

Japanese Foreign Patent Publication and Machine translation for JP 6037563 B2; Title: Multi-cylinder Rotary Compressor and Refrigeration Cycle Apparatus; Published: Dec. 7, 2016. (Year: 2016).*
(Continued)

*Primary Examiner* — Mary A Davis
(74) *Attorney, Agent, or Firm* — Spencer Fane LLP

(57) ABSTRACT

A compressor unit includes a compressor body including a compression mechanism, and an accumulator connected to the compressor body. The compression mechanism includes a cylinder, a piston to rotate eccentrically in the cylinder, and a blade partitioning an interior of a compression chamber of the cylinder into low and high pressure chambers. A frequency one time an operation frequency n of the compressor body and a frequency three times the operation frequency n of the compressor body are a 1n frequency and a 3n frequency, respectively. A phase difference θ between a phase of a transfer function of the 1n frequency of the accumulator and a phase of a transfer function of the 3n frequency of the accumulator is $-20° \geq \theta \geq -60°$ with respect to a peak of the 1n frequency where the phase lag is positive, at a maximum number of revolutions of the compressor body.

7 Claims, 11 Drawing Sheets

(52) U.S. Cl.
CPC .... *F04C 2240/804* (2013.01); *F04C 2270/12* (2013.01); *F04C 2270/15* (2013.01)

(56) References Cited

OTHER PUBLICATIONS

Japanese Foreign Patent Publication and Machine translation for JP 6041721 B2; Title: Multi-cylinder Rotary Compressor and Refrigeration Cycle Apparatus; Published: Dec. 14, 2016. (Year: 2016).*
International Search Report of corresponding PCT Application No. PCT/JP2022/030262 dated Oct. 11, 2022.
International Preliminary Report of corresponding PCT Application No. PCT/JP2022/030262 dated Apr. 11, 2024.
European Search Report of corresponding EP Application No. 22 87 5601.1 dated Feb. 26, 2025.

* cited by examiner

COMPRESSOR UNIT AND REFRIGERATION APPARATUS WITH REDUCED VIBRATIONS

CROSS-REFERENCE TO RELATED APPLICATIONS

This is a continuation of International Application No. PCT/JP2022/030262 filed on Aug. 8, 2022, which claims priority to Japanese Patent Application No. 2021-161444, filed on Sep. 30, 2021. The entire disclosures of these applications are incorporated by reference herein.

BACKGROUND

Technical Field

The present disclosure relates to a compressor unit and a refrigeration apparatus.

Background Art

Japanese Unexamined Patent Publication No. 2001-317479 discloses a vertical compressor configured to reduce vibrations transmitted to an accumulator through adjustment of the position of a bracket to which the accumulator is attached, such that the natural frequency of the accumulator is higher than the operation frequency of the compressor during operation of the compressor.

SUMMARY

A first aspect of the present disclosure is directed to a compressor unit including a compressor body including a compression mechanism, and an accumulator connected to the compressor body. The compression mechanism includes a cylinder, a piston configured to rotate eccentrically in the cylinder, and a blade partitioning an interior of a compression chamber of the cylinder into a low-pressure chamber and a high-pressure chamber. A frequency that is one time an operation frequency n of the compressor body and a frequency that is three times the operation frequency n of the compressor body are a 1n frequency and a 3n frequency, respectively. A phase difference θ between a phase of a transfer function of the 1n frequency of the accumulator and a phase of a transfer function of the 3n frequency of the accumulator is $-20° \geq \theta \geq 60°$ with respect to a peak of the 1n frequency where the phase lag is positive, at a maximum number of revolutions of the compressor body.

DETAILED DESCRIPTION OF EMBODIMENT(S)

Embodiments

Figure 1:
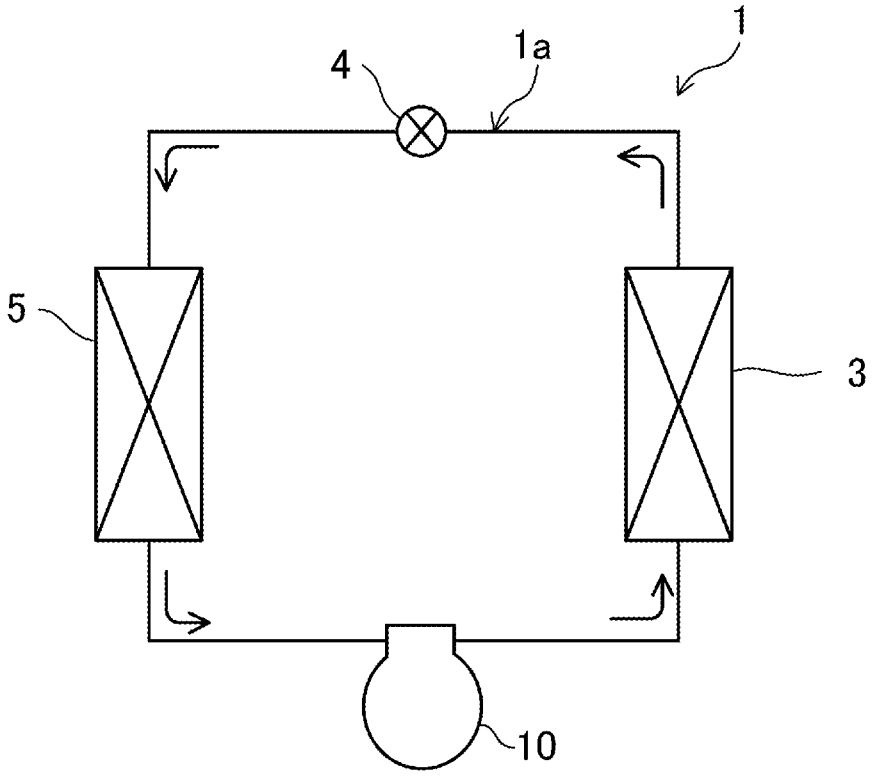
FIG. 1 is a refrigerant circuit diagram showing a configuration of a refrigeration apparatus according to an embodiment.

As illustrated in FIG. 1, a compressor unit (10) is provided in a refrigeration apparatus (1). The refrigeration apparatus (1) includes a refrigerant circuit (la) filled with a refrigerant. The refrigerant circuit (la) includes a compressor unit (10), a radiator (3), a decompression mechanism (4), and an evaporator (5). The decompression mechanism (4) is, for example, an expansion valve. The refrigerant circuit (la) performs a vapor compression refrigeration cycle.

In the refrigeration cycle, the refrigerant compressed by the compressor unit (10) dissipates heat to the air in the radiator (3). The refrigerant which has dissipated heat is decompressed by the decompression mechanism (4) and evaporates in the evaporator (5). The evaporated refrigerant is sucked into the compressor unit (10).

The refrigeration apparatus (1) is an air conditioner. The air conditioner may be any of a cooling-only apparatus, a heating-only apparatus, or an air conditioner switchable between cooling and heating. In this case, the air conditioner has a switching mechanism (e.g., a four-way switching valve) configured to switch the direction of circulation of the refrigerant. The refrigeration apparatus (1) may be a water heater, a chiller unit, or a cooling apparatus configured to cool air in an internal space. The cooling apparatus cools the air in an internal space of a refrigerator, a freezer, a container, or the like.

Figure 2:
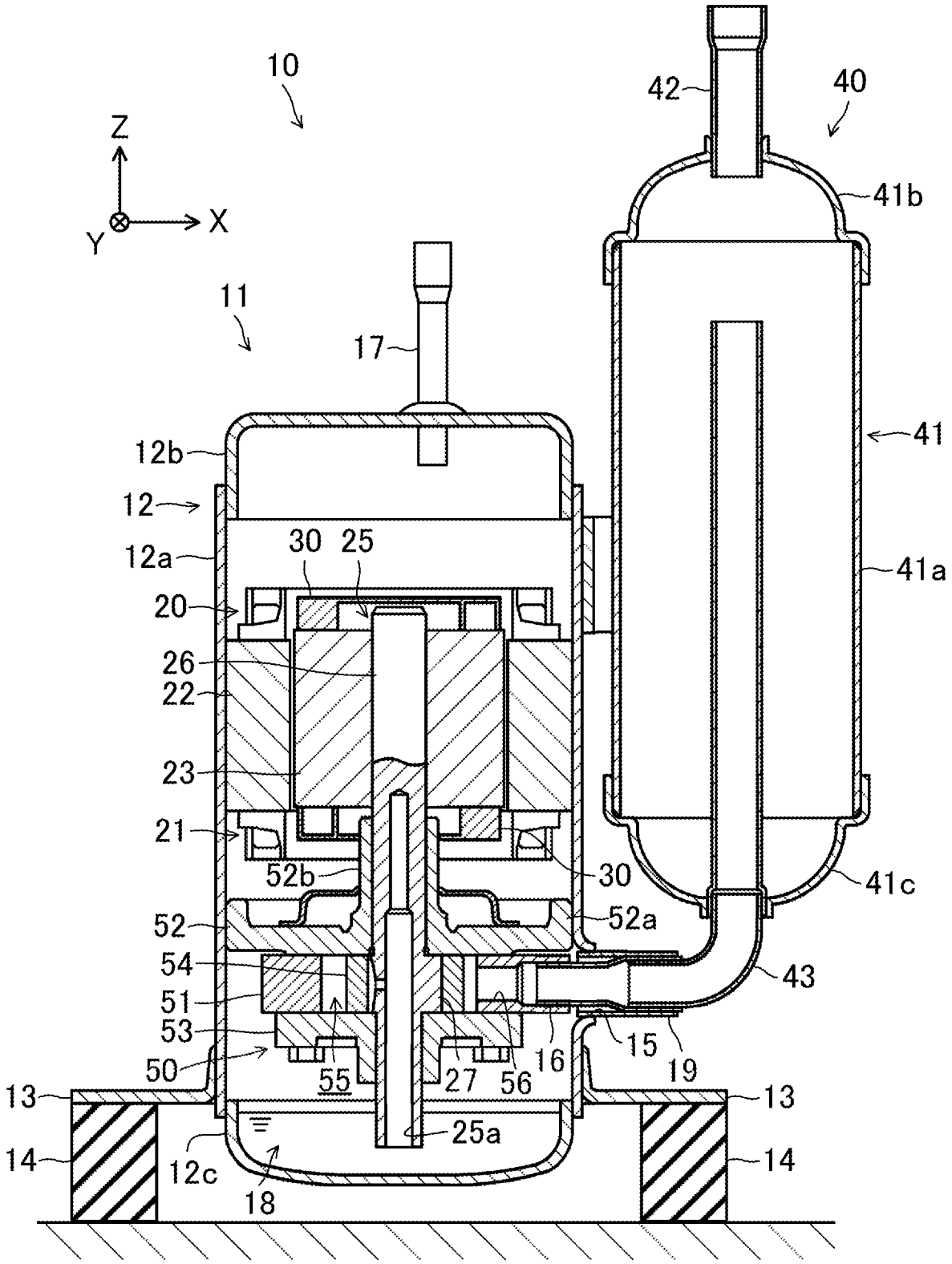
FIG. 2 is a longitudinal sectional view illustrating a configuration of a compressor unit.

As illustrated in FIG. 2, the compressor unit (10) includes a compressor body (11) and an accumulator (40). The accumulator (40) is connected to the compressor body (11). The compressor body (11) includes a casing (12), a drive mechanism (20), and a compression mechanism (50).

In FIG. 2, the lateral direction in which the compressor body (11) and the accumulator (40) are arranged will be referred to as the "X-axis direction," the depth direction of the sheet orthogonal to the X-axis direction as the "Y-axis direction," and the vertical direction along which the compressor body (11) stands as the "Z-axis direction."

The casing (12) is configured as a vertically long cylindrical closed container. The casing (12) includes a barrel (12*a*), an upper cup (12*b*), and a lower cup (12*c*). The barrel (12*a*) is in the shape of a cylinder extending in the vertical direction, with both axial ends open. The upper cup (12*b*) is fixed to the upper end of the barrel (12*a*) to close the upper opening of the barrel (12*a*). The lower cup (12*c*) is fixed to the lower end of the barrel (12*a*) to close the lower opening of the barrel (12*a*). A suction pipe (16) passes through, and is fixed to, the barrel (12*a*). A discharge pipe (17) passes through, and is fixed to, the upper cup (12*b*).

The barrel (12*a*) of the casing (12) is provided with a plurality of support legs (13) spaced apart from one another in the circumferential direction. A vibration isolating member (14) is provided below each support leg (13). The vibration isolating member (14) is made of, for example, a rubber material. The casing (12) is supported by the vibration isolating members (14) via the support legs (13).

The casing (12) has, at its bottom, an oil reservoir (18). The oil reservoir (18) is formed by the inner wall of a lower portion of the barrel (12*a*) and the lower cup (12*c*). The oil reservoir (18) stores a lubricant. The lubricant lubricates sliding portions of the compression mechanism (50) and a drive shaft (25).

The drive mechanism (20) is housed in the casing (12). The drive mechanism (20) includes a motor (21), the drive shaft (25), and balance weights (30). The motor (21) is disposed above the compression mechanism (50). The motor (21) includes a stator (22) and a rotor (23). The balance weights (30) are provided at both axial ends of the rotor (23).

The stator (22) is fixed to the inner peripheral surface of the barrel (12*a*) of the casing (12). The rotor (23) passes through the stator (22) in the vertical direction. The drive shaft (25) is placed in the axis of the rotor (23) and fixed thereto. The drive shaft (25) is driven to rotate together with the rotor (23) when the motor (21) is energized.

The drive shaft (25) is located on the axis of the barrel (12*a*) of the casing (12). An oil supply passage (25*a*) is formed inside the drive shaft (25). The lower end of the drive shaft (25) is immersed in the oil reservoir (18). The lubricant stored in the oil reservoir (18) is supplied to the sliding portions of the compression mechanism (50) and the drive shaft (25) through the oil supply passage (25*a*) inside the drive shaft (25).

The drive shaft (25) has a main shaft portion (26) and an eccentric portion (27). An upper portion of the main shaft portion (26) is fixed to the rotor (23) of the motor (21). The eccentric portion (27) has an axis decentered by a predetermined distance with respect to the axis of the main shaft portion (26).

A portion of the main shaft portion (26) above the eccentric portion (27) is rotatably supported by a boss portion (52*b*) of a front head (52) to be described later. A portion of the main shaft portion (26) below the eccentric portion (27) is rotatably supported by a rear head (53) to be described later.

The compression mechanism (50) is housed in the casing (12). The compression mechanism (50) is disposed below the motor (21). The compression mechanism (50) includes a cylinder (51), the front head (52), the rear head (53), a piston (54), and a blade (57).

The cylinder (51) is configured as a flat and substantially annular member. The cylinder (51) has a circular compression chamber (55) at its center. The cylinder (51) has a suction passage (56) extending in a radial direction. The downstream end of the suction passage (56) communicates with the compression chamber (55). The suction pipe (16) is connected to the upstream end of the suction passage (56).

The barrel (12*a*) of the casing (12) has a through hole (15) at a position facing the suction passage (56). A joint pipe (19) is connected to the through hole (15) of the casing (12). The joint pipe (19) is made of a cylindrical member made of a metal material. The joint pipe (19) is joined to the barrel (12*a*) of the casing (12) while being fitted in the through hole (15). The joint pipe (19) extends from the barrel (12*a*) of the casing (12) toward the outside of the casing (12).

The suction pipe (16) is connected to the suction passage (56) of the cylinder (51) and extends through the inside of the joint pipe (19) to the outside of the casing (12). The outer peripheral surface of the suction pipe (16) is brazed to the inner peripheral surface of the joint pipe (19).

The front head (52) is disposed on an upper portion of the cylinder (51). The front head (52) covers the internal space of the cylinder (51) from above. The front head (52) includes an annular plate portion (52*a*) and the boss portion (52*b*).

The annular plate portion (52*a*) is made of a flat annular member and is stacked on an upper end portion of the cylinder (51). The annular plate portion (52*a*) is fixed to the inner peripheral surface of the barrel (12*a*) of the casing (12). The boss portion (52*b*) is made of a tubular member extending upward from a radially central portion of the annular plate portion (52*a*). The boss portion (52*b*) rotatably supports the main shaft portion (26) of the drive shaft (25). The front head (52) has a discharge passage (not shown) passing through the annular plate portion (52*a*) in the axial direction.

The rear head (53) is disposed on a lower portion of the cylinder (51). The rear head (53) covers the internal space of the cylinder (51) from below. The rear head (53) rotatably supports the main shaft portion (26) of the drive shaft (25).

Figure 3:
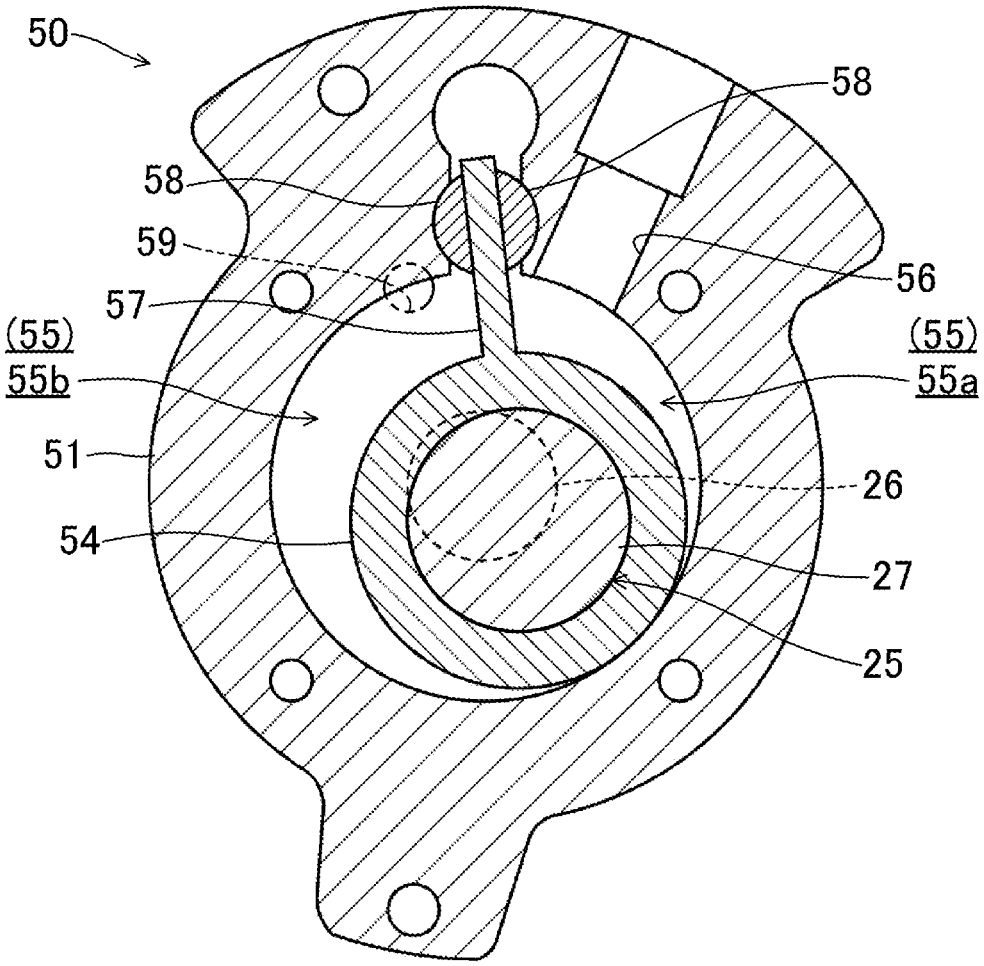
FIG. 3 is a plan sectional view illustrating a configuration of a compression mechanism.

As illustrated also in FIG. 3, the piston (54) is housed in the cylinder (51). The blade (57) is integrated with the piston (54). The compression chamber (55) is defined by the cylinder (51) and the piston (54). The piston (54) has a perfect circular annular shape. The eccentric portion (27) of the drive shaft (25) is fitted in the piston (54). The interior of the compression chamber (55) is partitioned into a low-pressure chamber (55*a*) and a high-pressure chamber (55*b*) by the blade (57). The blade (57) is supported by a pair of bushes (58), which allow oscillation of the blade (57).

The piston (54) rotates eccentrically in the cylinder (51) when the drive shaft (25) is driven to rotate. The refrigerant flowing through the suction pipe (16) is sucked into the low-pressure chamber (55*a*) through the suction passage (56) as the volume of the low-pressure chamber (55*a*) is gradually increased by the eccentric rotation of the piston (54).

Next, the low-pressure chamber (55*a*) is isolated from the suction passage (56), and the isolated space forms the high-pressure chamber (55*b*). The internal pressure of the high-pressure chamber (55*b*) increases as the volume of the high-pressure chamber (55*b*) gradually decreases. When the internal pressure of the high-pressure chamber (55*b*) exceeds a predetermined pressure, the refrigerant in the high-pressure chamber (55*b*) flows out of the compression mechanism (50) through a discharge passage (59). This high-pressure refrigerant flows upward in the internal space of the casing (12) and passes through core cuts (not shown) or other portions of the motor (21). The high-pressure refrigerant that has flowed upward of the motor (21) is transferred to the refrigerant circuit through the discharge pipe (17).

Configuration of Accumulator

The accumulator (40) is connected to the upstream side of the compressor body (11). The accumulator (40) temporarily stores the refrigerant before suction into the compressor body (11) and provides gas-liquid separation of a liquid refrigerant and refrigerating machine oil which are contained in a refrigerant gas.

The accumulator (40) includes a container body (41), an inlet pipe (42), and an outlet pipe (43). The inlet pipe (42) allows the refrigerant to flow into the container body (41). The outlet pipe (43) allows the refrigerant to flow out of the container body (41).

The container body (41) is configured as a vertically long cylindrical member.

The container body (41) includes a barrel (41*a*), an upper housing (41*b*), and a lower housing (41*c*). The barrel (41*a*) is in the shape of a cylinder extending in the vertical direction with both axial ends open. The upper housing (41*b*) is fixed to the upper end of the barrel (41*a*) to close the upper opening of the barrel (41*a*). The lower housing (41*c*) is fixed to the lower end of the barrel (41*a*) to close the lower opening of the barrel (41*a*).

The inlet pipe (42) is connected to an upper portion of the upper housing (41*b*). A lower end portion of the inlet pipe (42) is open near an upper portion of the internal space of the container body (41). The outlet pipe (43) is connected to a lower portion of the lower housing (41*c*). An upper end portion of the outlet pipe (43) extends upward in the container body (41) and is open near the upper portion of the internal space of the container body (41).

A lower end portion of the outlet pipe (43) extends downward from the lower end of the container body (41) and is then bent toward the suction pipe (16) of the compressor body (11) so as to be connected to the suction pipe (16).

1n Frequency and 3n Frequency

There has been a request to increase the number of revolutions of the compressor body (11) to further improve the compressor capacity. Unfortunately, an increase in the number of revolutions of the compressor body (11) increases vibrations transmitted from the compressor body (11) to the accumulator (40), which propagate to an entire outdoor unit via the inlet pipe (42), resulting in higher piping stress and greater noise generated in the product.

To address this, the inventors of this application have focused on the difference in vibration transmissibility characteristics between the 1n frequency that is one time the operation frequency n of the compressor body (11) and the 3n frequency that is three times the operation frequency n of the compressor body (11), as a factor that increases the vibration of the accumulator (40).

Specifically, S in the exciting force at the 1n frequency, torque and the centrifugal forces of the piston (54) and the rotor (23) are great. In contrast, in the exciting force at the 3n frequency, torque is great. The timing at which the exciting force is transmitted as the accumulator vibration differs depending on the frequencies. In other words, the vibration transmission phase differs between the 1n frequency and the 3n frequency.

Depending on the phase difference between the 1n frequency and the 3n frequency, the following phenomenon may occur: the peak vibrations at the 1n frequency and at the 3n frequency overlap each other, raising the peak-to-peak value of accumulator vibration.

To address this, in this embodiment, the optimum phase difference between the 1n frequency and the 3n frequency will be studied so that an increase in the vibration transmitted from the compressor body (11) to the accumulator (40) can be substantially prevented even if the number of revolutions of the compressor body (11) is increased.

Figure 4:
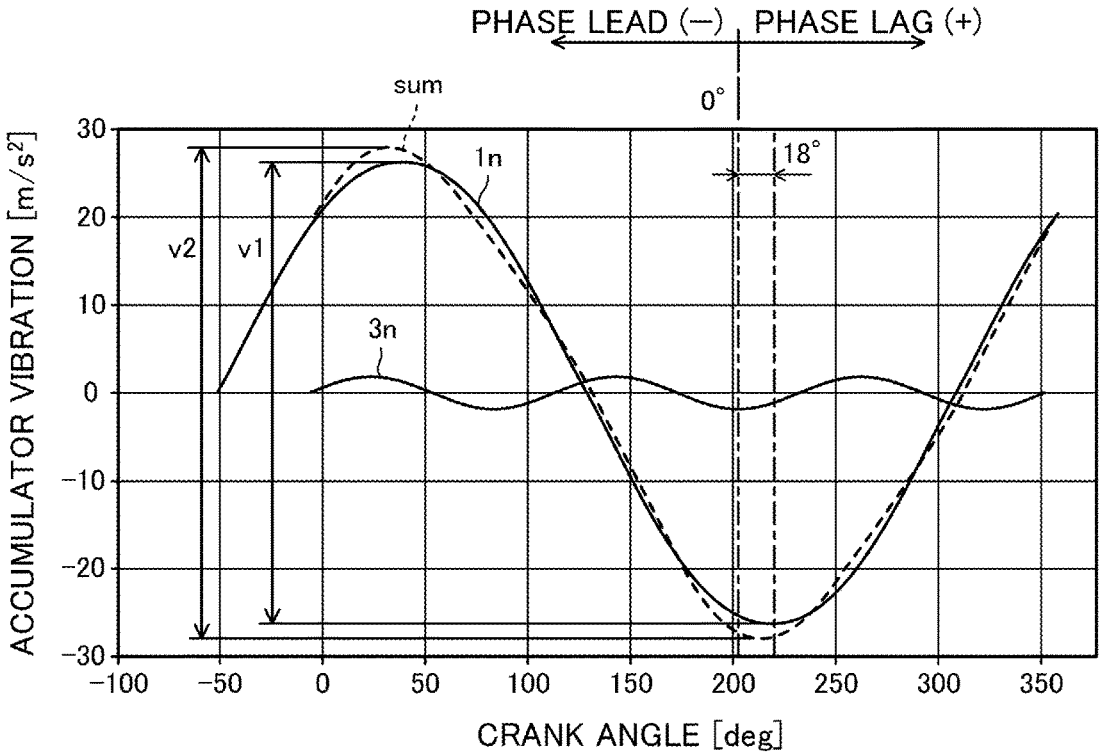
FIG. 4 is a graph showing the relation between the crank angle and accumulator vibration in a situation where the phase difference is 0°.

FIG. 4 is a graph showing the relation between the crank angle and accumulator vibration in a situation where the phase difference is 0°. In the example shown in FIG. 4, the maximum number of revolutions of the compressor body (11) is equal to or greater than 118 rps, specifically 120 rps. The discharge pressure is 3.5 MPa, and the suction pressure is 1.1 MPa. The phase lag is positive, and the phase lead is negative.

Here, due to the conditions of the discharge temperature and suction temperature of the refrigerant, the phase of the 3n frequency is at a position that leads the phase of the 1n frequency by about 11° to 19° in advance. In the example shown in FIG. 4, the position where the phase of the transfer function of the 3n frequency of the accumulator (40) is shifted by 18° to the phase lead side from the phase of the transfer function of the 1n frequency is assumed to be the phase difference $\theta=0°$ with respect to the peak of the 1n frequency.

As shown in FIG. 4, when the phase difference $\theta$ is 0°, the peak vibration at the 1n frequency and the peak vibration at the 3n frequency overlap each other. Thus, the peak-to-peak value v2 of a synthesis of the waveform of the 1n frequency and the waveform of the 3n frequency (the dotted waveform referred to as "sum" in FIG. 4) is greater than the peak-to-peak value v1 of the waveform of the 1n frequency, resulting in an increase in the vibrations transmitted from the compressor body (11) to the accumulator (40).

Figure 5:
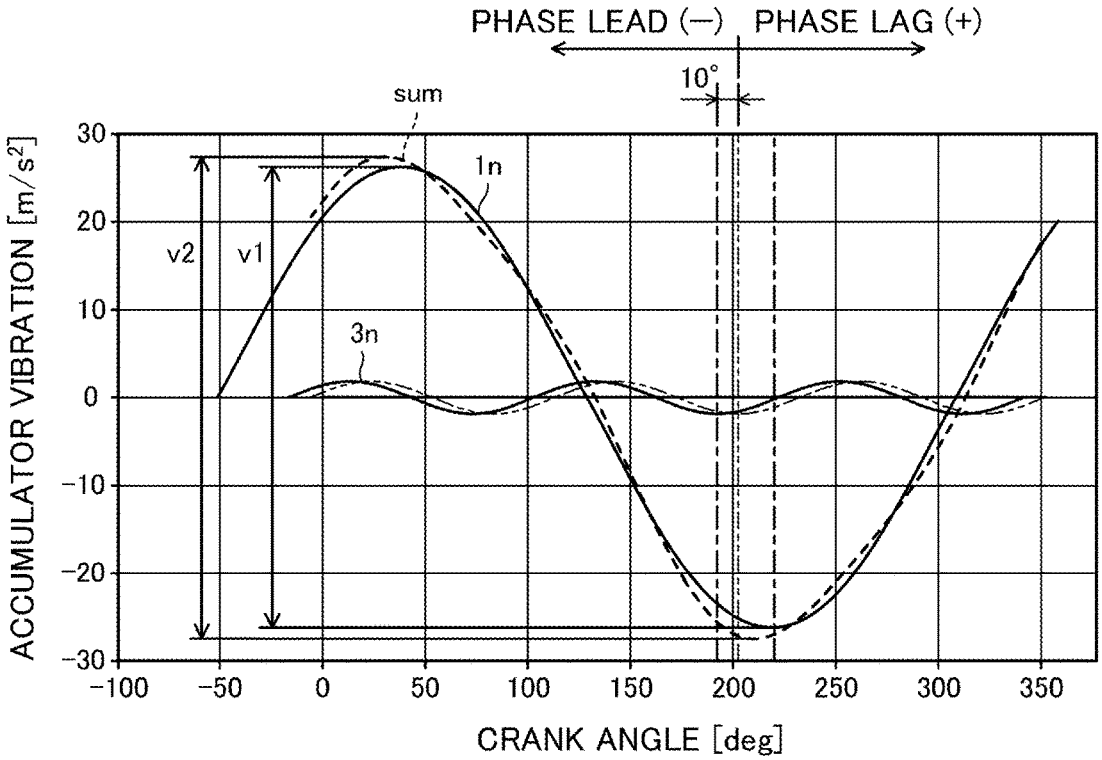
FIG. 5 is a graph showing the relation between the crank angle and accumulator vibration in a situation where the phase difference is 10°.

As shown in FIG. 5, when the phase difference is 10°, the peak vibration at the 1n frequency and the peak vibration at the 3n frequency overlap each other. Thus, the peak-to-peak value v2 of a synthesis of the waveform of the 1n frequency and the waveform of the 3n frequency is greater than the peak-to-peak value v1 of the waveform of the 1n frequency, resulting in an increase in the vibrations transmitted from the compressor body (11) to the accumulator (40).

Figure 6:
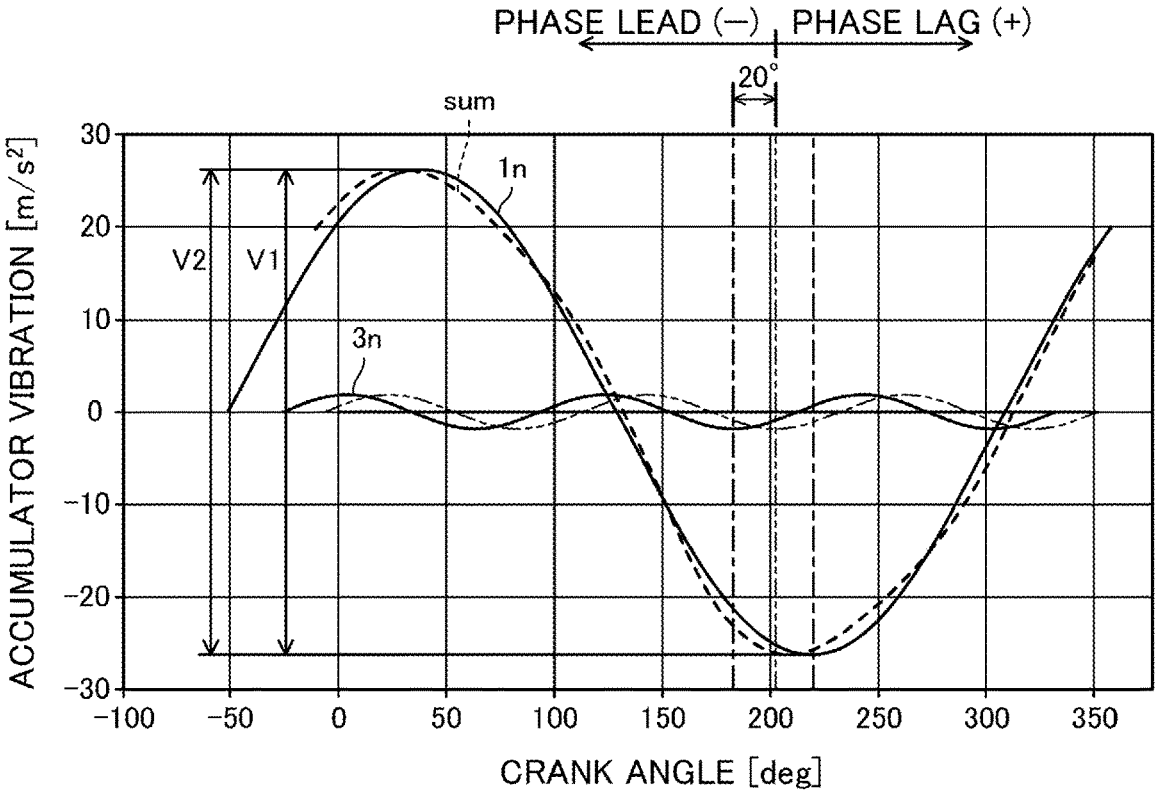
FIG. 6 is a graph showing the relation between the crank angle and accumulator vibration in a situation where the phase difference is 20°.

As shown in FIG. 6, when the phase difference is 20°, the peak vibration at the 1n frequency and the peak vibration at the 3n frequency are shifted from each other. Thus, the peak-to-peak value v1 of the waveform of the 1n frequency and the peak-to-peak value v2 of a synthesis of the waveform of the 1n frequency and the waveform of the 3n frequency are substantially the same, so that it is possible to substantially prevent an increase in the vibration transmitted from the compressor body (11) to the accumulator (40).

Figure 7:
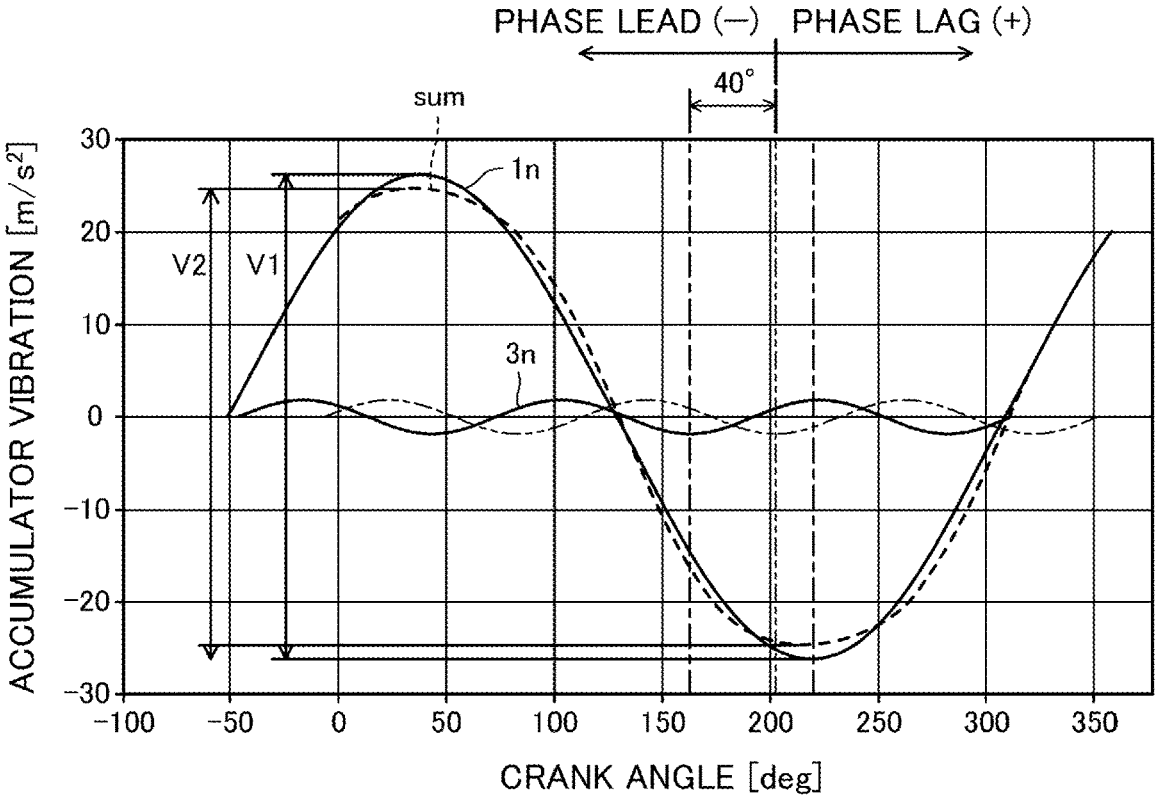
FIG. 7 is a graph showing the relation between the crank angle and accumulator vibration in a situation where the phase difference is 40°.

As shown in FIG. 7, when the phase difference is 40°, the peak vibration at the 1n frequency and the peak vibration at the 3n frequency are shifted from each other, and the crest and the trough overlap each other. Thus, the peak-to-peak value v2 of a synthesis of the waveform of the 1n frequency and the waveform of the 3n frequency is smaller than the peak-to-peak value v1 of the waveform of the 1n frequency, so that it is possible to substantially prevent an increase in the vibration transmitted from the compressor body (11) to the accumulator (40) more.

Figure 8:
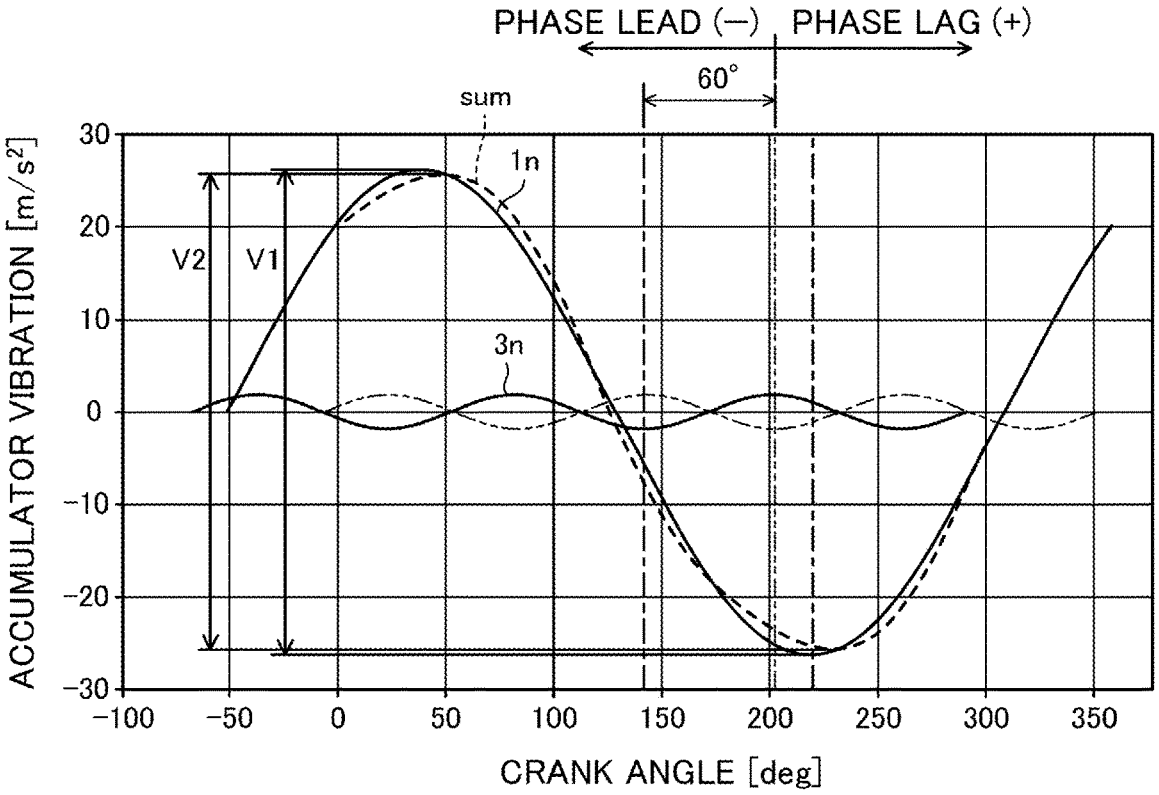
FIG. 8 is a graph showing the relation between the crank angle and accumulator vibration in a situation where the phase difference is 60°.

As shown in FIG. 8, when the phase difference is 60°, the peak vibration at the 1n frequency and the peak vibration at the 3n frequency are shifted from each other. Thus, the peak-to-peak value v1 of the waveform of the 1n frequency and the peak-to-peak value v2 of a synthesis of the waveform of the 1n frequency and the waveform of the 3n frequency are substantially the same, so that it is possible to substantially prevent an increase in the vibration transmitted from the compressor body (11) to the accumulator (40).

Figure 9:
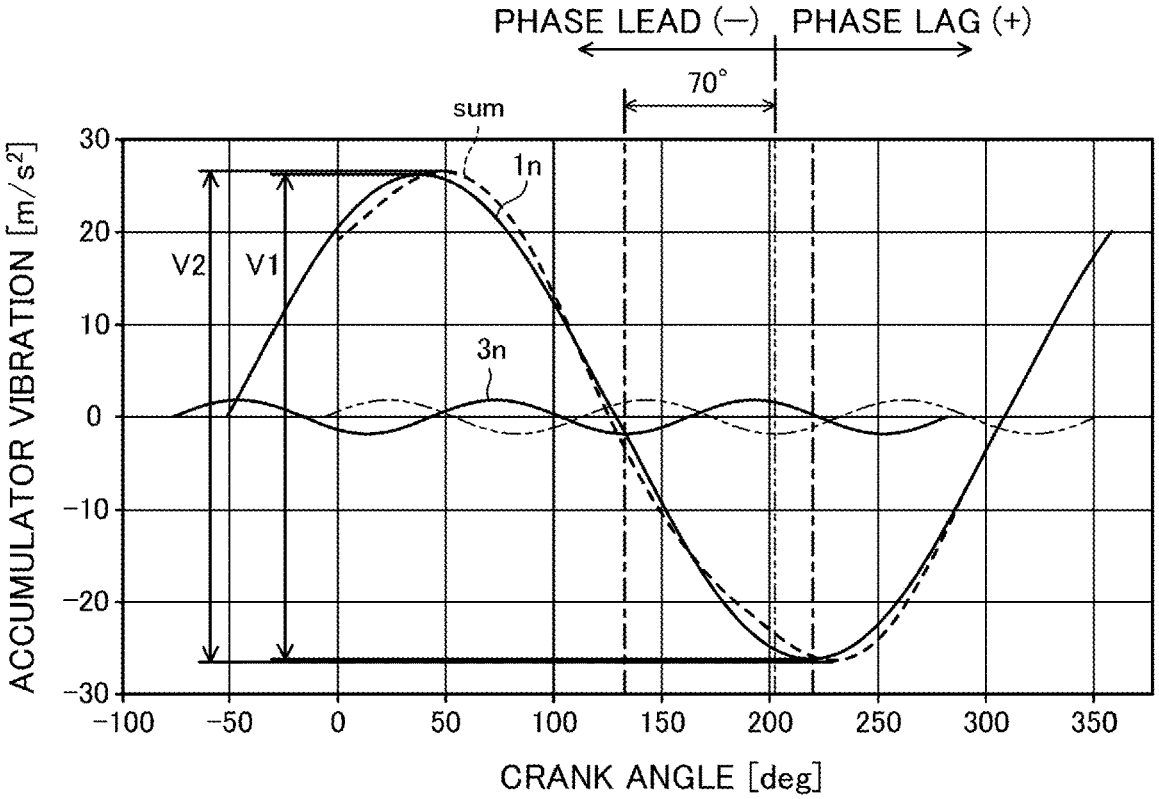
FIG. 9 is a graph showing the relation between the crank angle and accumulator vibration in a situation where the phase difference is 70°.

As shown in FIG. 9, when the phase difference is 70°, the peak vibration at the 1n frequency and the peak vibration at the 3n frequency partially overlap each other, as compared to the case when the phase difference is 60°. Thus, the peak-to-peak value v2 of a synthesis of the waveform of the 1n frequency and the waveform of the 3n frequency is slightly greater than, or substantially equal to, the peak-to-peak value v1 of the waveform of the 1n frequency, which is less effective in substantially preventing an increase in the vibration transmitted from the compressor body (11) to the accumulator (40).

Figure 10:
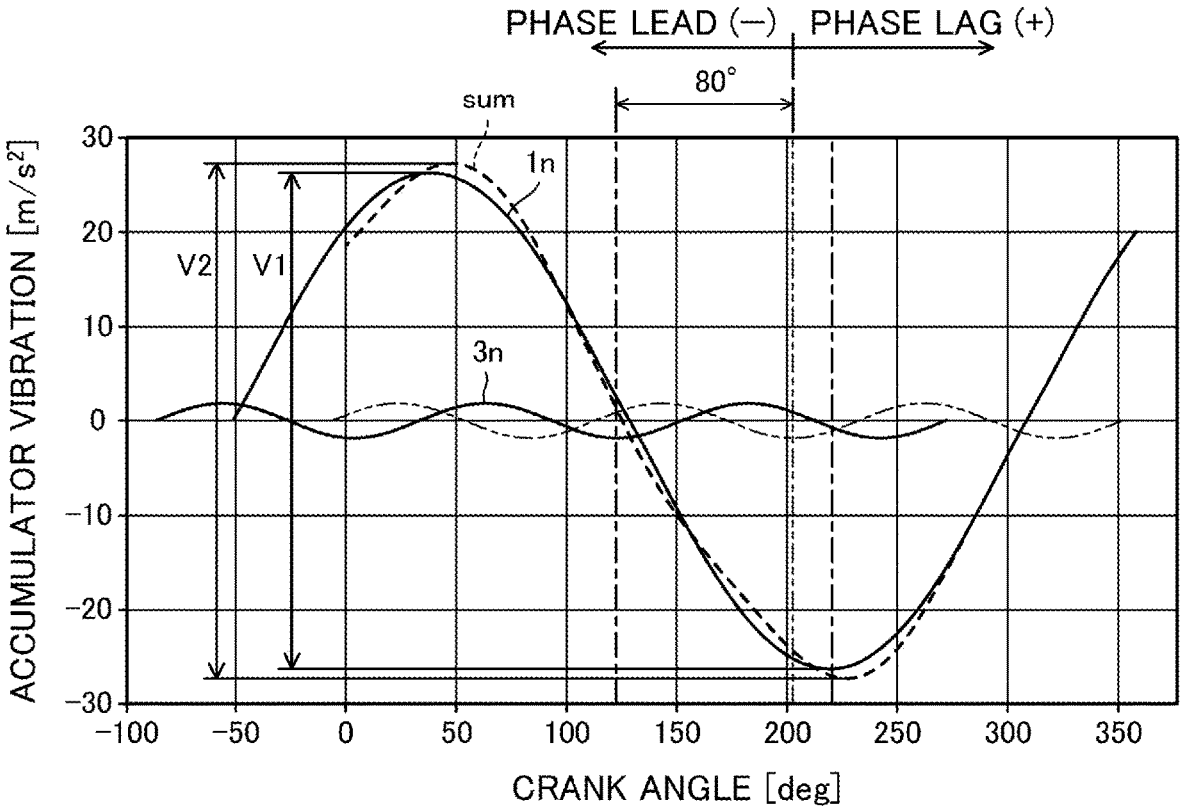
FIG. 10 is a graph showing the relation between the crank angle and accumulator vibration in a situation where the phase difference is 80°.

As shown in FIG. 10, when the phase difference is 80°, the peak vibration at the 1n frequency and the peak vibration at the 3n frequency overlap each other. Thus, the peak-to-peak value v2 of a synthesis of the waveform of the 1n frequency and the waveform of the 3n frequency is greater than the peak-to-peak value v1 of the waveform of the 1n frequency, resulting in an increase in the vibrations transmitted from the compressor body (11) to the accumulator (40).

According to this embodiment, based on the results of the studies shown in FIGS. 4 to 10 as described above, the phase difference θ between the phase of the transfer function of the 1n frequency of the accumulator (40) and the phase of the transfer function of the 3n frequency of the accumulator (40) is set to be $-20° \geq \theta \geq -60°$ with respect to the peak of the 1n frequency where the phase lag is positive, at a maximum number of revolutions of the compressor body (11).

By this setting, the peak vibration at the 1n frequency and the peak vibration at the 3n frequency are shifted from each other without overlapping each other. The peak-to-peak value of the vibration of the accumulator (40) thus becomes smaller, so that it is possible to substantially prevent an increase in the vibration transmitted from the compressor body (11) to the accumulator (40).

Figure 11:
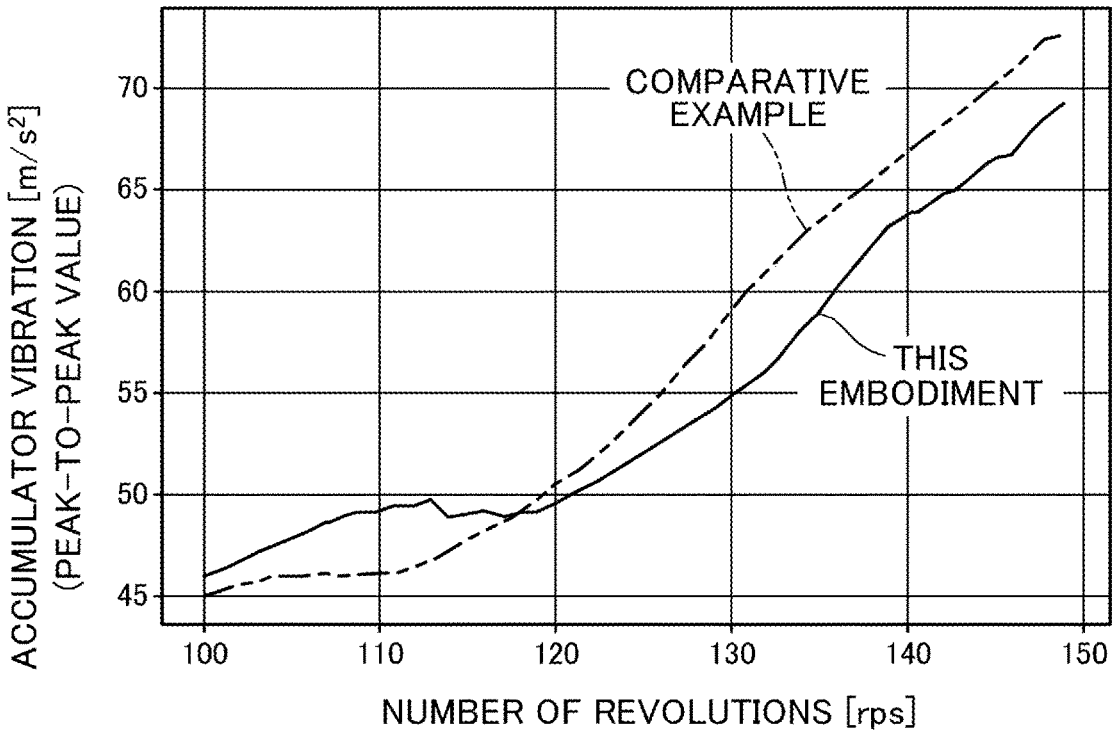
FIG. 11 is a graph showing the relation between the number of revolutions of a compressor body and the peak-to-peak value of accumulator vibration.

FIG. 11 is a graph showing the relation between the number of revolutions of the compressor body and the peak-to-peak value of the accumulator vibration. In FIG. 11, the present embodiment in which the consideration is given to the phase difference θ between the 1n frequency and the 3n frequency is indicated by the solid line, and a comparative example in which no consideration is given to the phase difference θ between the 1n frequency and the 3n frequency is indicated by the phantom line.

In the example shown in FIG. 11, the exciting force at the 1n frequency is determined such that torque and centrifugal force are equal to each other when the number of revolutions of the compressor body (11) is 100 rps, considering the whirling of the piston (54). The transmissibility characteristics of the 1n frequency and the 3n frequency are both assumed to be one. Here, the exciting force F_1n at the 1n frequency and the exciting force F_3 n at the 3n frequency are expressed by the following formulae, where R represents the maximum number of revolutions of the compressor body (11):

$$\text{F_1n} = 0.5 \times \left(1 + (R/100)^2\right) \quad (1)$$

$$\text{F_3}n = 1 \quad (2)$$

As shown in FIG. 11, the peak-to-peak value of the comparative example is smaller than the peak-to-peak value of this embodiment in a range where the number of revolutions of the compressor body (11) is small. However, the peak-to-peak value of this embodiment is smaller than the peak-to-peak value of the comparative example, when the number of revolutions of the compressor body (11) reaches 118 rps or more. The graph of FIG. 11 shows that the vibrations of the accumulator (40) can be reduced more in the compressor unit (10) according to this embodiment than in the comparative example in a high rotational speed range of the piston (54).

Accordingly, in this embodiment, the maximum number of revolutions of the compressor body (11) is set to be equal to or greater than 118 rps. The maximum number of revolutions of the compressor body (11) is preferably equal to or greater than 130 rps.

Next, optimum ranges of the 1n frequency and 3n frequency for setting the phase difference θ to be in the above-described range will be studied. In the following description, vibrations of an upper portion of the accumulator (40) in the Y-axis direction will be studied.

First, rubber foot resonance (see FIG. 12), shaft resonance (see FIG. 13), and accumulator resonance (see FIG. 14) are factors that vibrate the accumulator (40).

Figure 12:
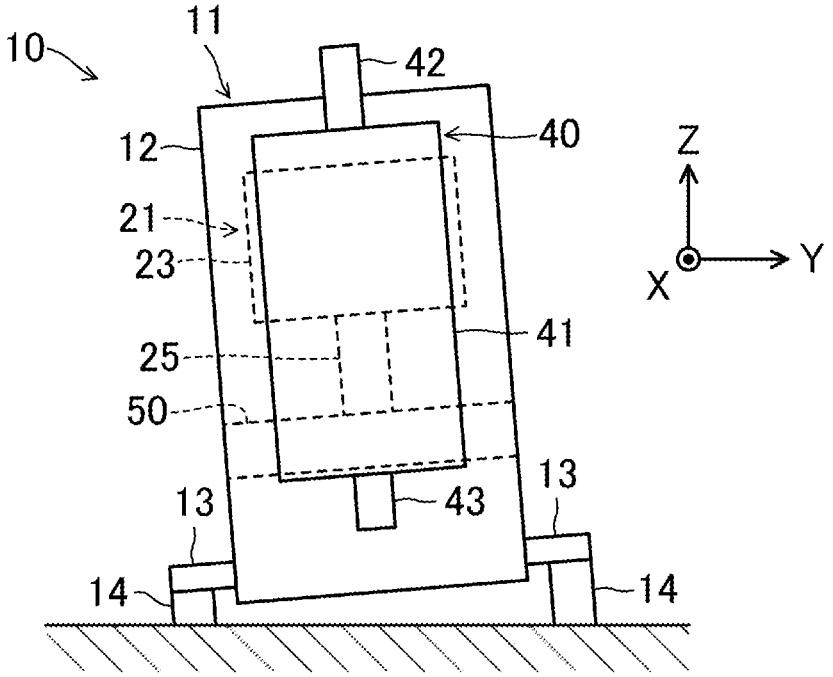
FIG. 12 is a diagram illustrating rubber foot resonance.

As illustrated in FIG. 12, the rubber foot resonance refers to the vibration of the accumulator (40) caused by elastic deformation of the rubber material as the vibration isolating member (14). In the example illustrated in FIG. 12, the compressor body (11) is inclined leftward, and the accumulator (40) is inclined leftward. Resonance design for the resonance frequency of the rubber foot resonance can be achieved by changing the stiffness of the vibration isolating member (14) and the weight of the compressor body (11) as appropriate.

Figure 13:
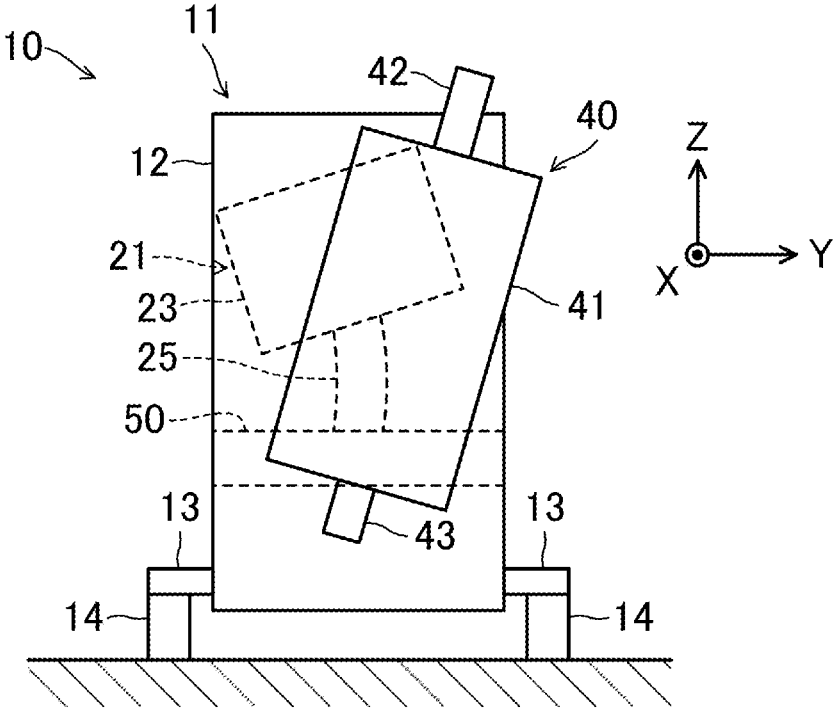
FIG. 13 is a diagram illustrating shaft resonance.

As illustrated in FIG. 13, the shaft resonance refers to the vibration of the accumulator (40) caused by elastic deformation of the drive shaft (25) inside the casing (12) of the compressor body (11). In the example illustrated in FIG. 13, the compressor body (11) remains supported by the vibration isolating members (14) and is not inclined, whereas the drive shaft (25) bends leftward inside the casing (12), and the accumulator (40) is inclined rightward. Resonance design for the resonance frequency of the shaft resonance can be achieved by changing the stiffness of the drive shaft (25), the weight of the rotor (23), the support stiffness of the accumulator (40), and the weight of the accumulator (40) as appropriate.

Figure 14:
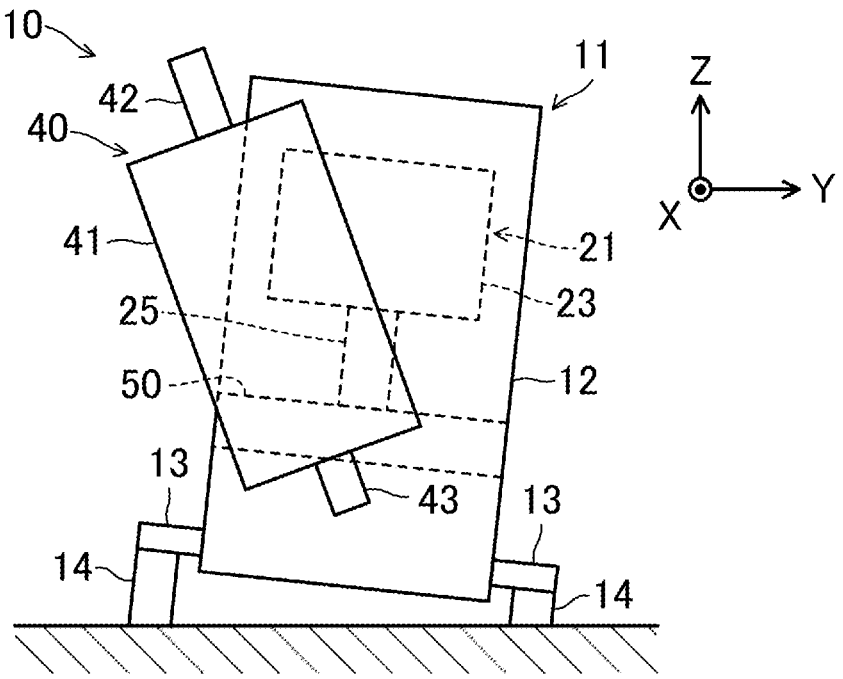
FIG. 14 is a diagram illustrating accumulator resonance.

As illustrated in FIG. 14, the accumulator resonance refers to the vibration of the accumulator (40) caused by the inclinations of the accumulator (40) and the compressor body (11) in opposite directions. In the example illustrated in FIG. 14, the compressor body (11) is inclined rightward, and the accumulator (40) is inclined leftward. Resonance design for the resonance frequency of the accumulator resonance can be achieved by changing the weight of the compressor body (11), the support stiffness of the accumulator (40), and the weight of the accumulator (40) as appropriate.

In this embodiment, the phase is advanced by utilizing antiresonance so that the exciting force at the 3n frequency will not be transmitted to the accumulator (40) later than the exciting force at the 1n frequency.

Figure 15:
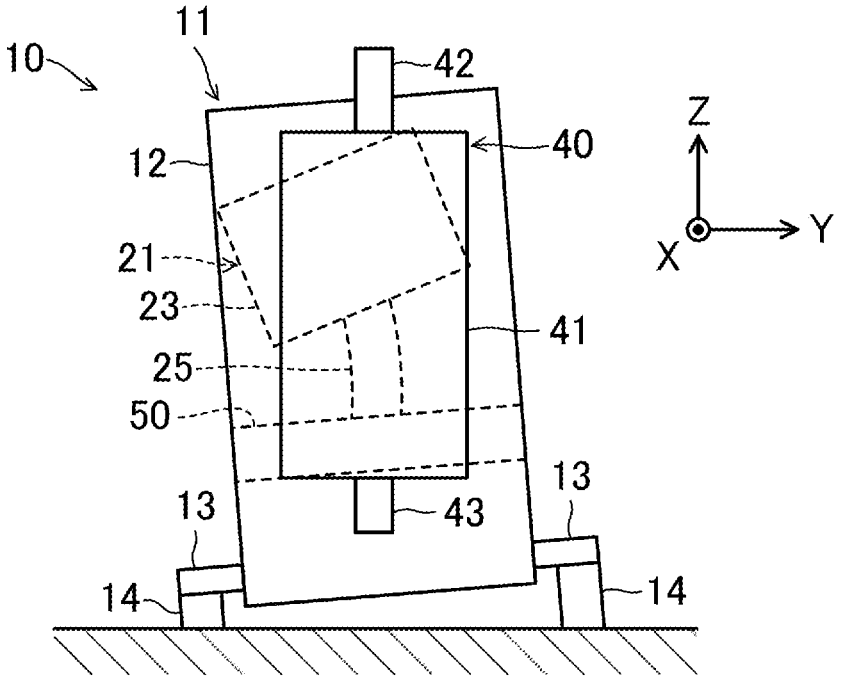
FIG. 15 is a diagram illustrating antiresonance that occurs when vibrations of rubber foot resonance and shaft resonance overlap.
Figure 16:
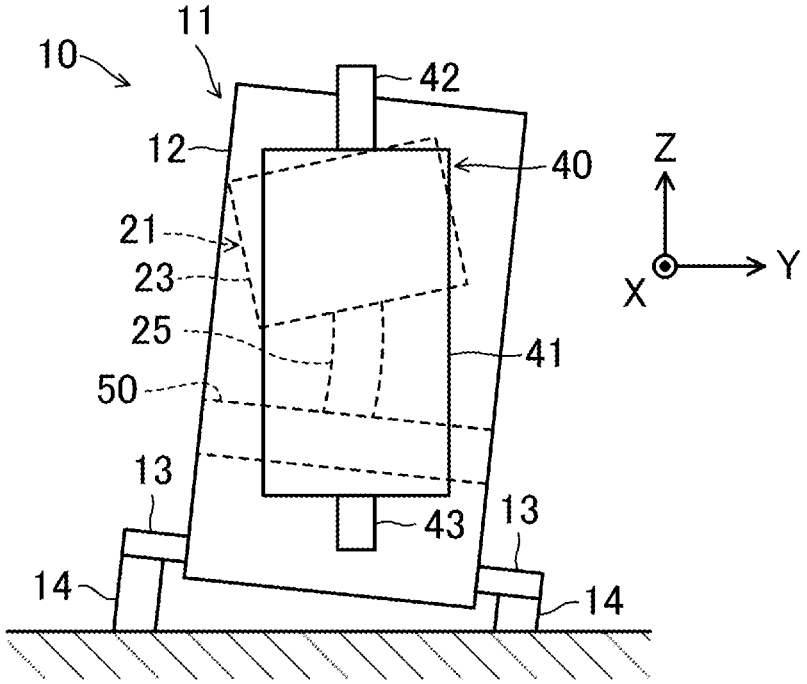
FIG. 16 is a diagram illustrating antiresonance that occurs when vibrations of shaft resonance and accumulator resonance overlap.

The antiresonance occurs when the vibrations of the rubber foot resonance and the shaft resonance overlap (see FIG. 15) and when the vibrations of the shaft resonance and the accumulator resonance overlap (see FIG. 16).

As illustrated in FIG. 15, in the antiresonance that occurs when the vibrations of the rubber foot resonance and the shaft resonance overlap, the compressor body (11) is inclined leftward and the drive shaft (25) is bent leftward inside the casing (12). The accumulator (40) is not inclined at this moment, making it possible to reduce vibrations transmitted to the accumulator (40).

As illustrated in FIG. 16, in the antiresonance that occurs when the vibrations of the shaft resonance and the accumulator resonance overlap, the drive shaft (25) is bent leftward inside the casing (12) and the compressor body (11) is inclined rightward. The accumulator (40) is not inclined at this moment, making it possible to reduce vibrations transmitted to the accumulator (40).

Figure 17:
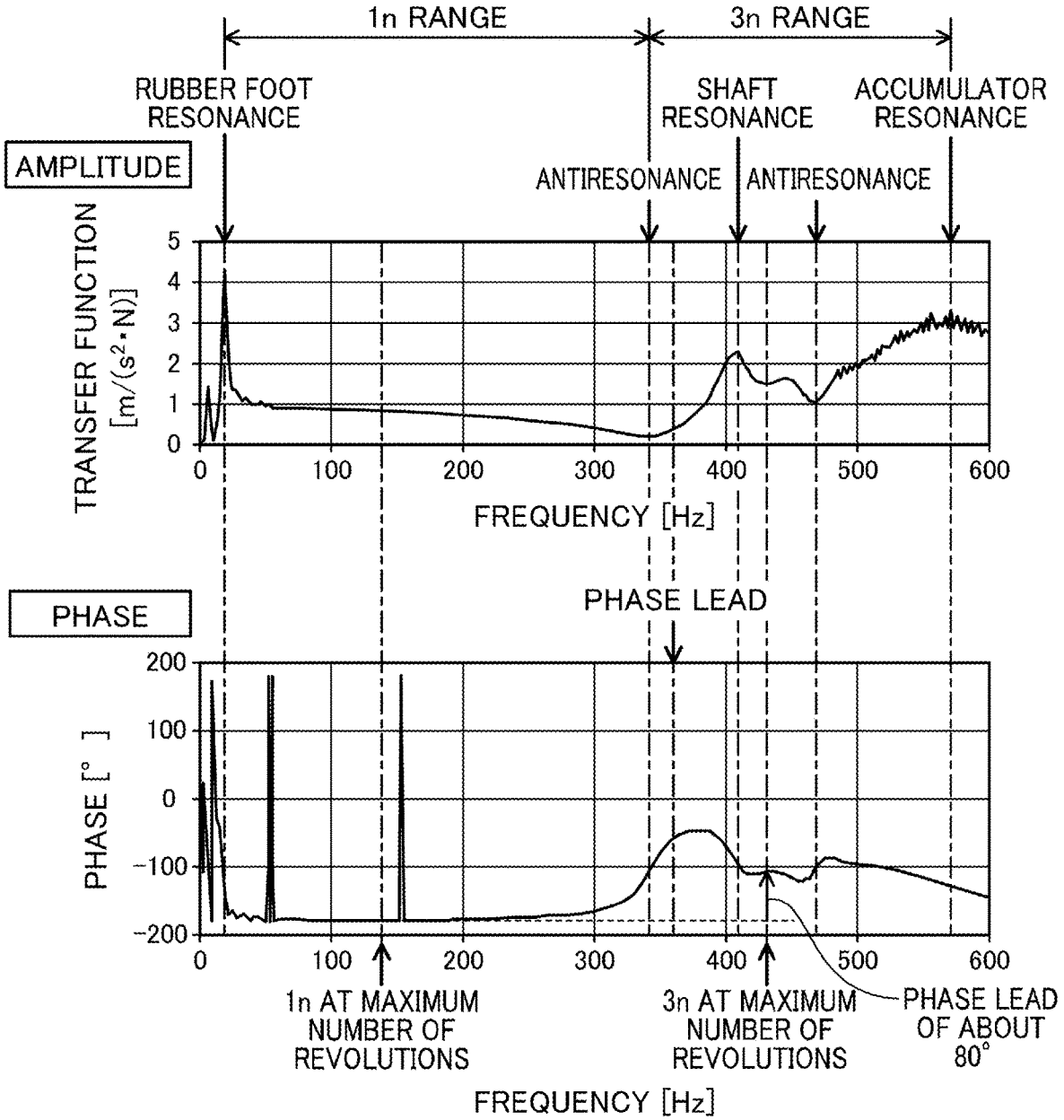
FIG. 17 illustrates graphs of the operation frequency of the compressor body and the transfer functions of the amplitude and phase of the accumulator.

As shown in FIG. 17, the phase of the 3n frequency at the maximum number of revolutions has a phase lead characteristic that leads the phase of the 1n at the maximum number of revolutions by about 80°. A phase lead of about 80° at the 3n frequency corresponds to about −27° (=−80/3) when viewed with reference to the time-series waveforms shown in FIGS. 4 to 10. Due to the phase lead characteristic of about 80°, the peak vibrations at the 1n frequency and at the 3n frequency are shifted so as not to overlap each other, thereby lowering the peak-to-peak value of vibration of the accumulator (40).

As shown in FIG. 17, the frequency of the rubber foot resonance in which the vibration isolating member (14) resonates is lower than the frequency of the shaft resonance in which the drive shaft (25) resonates. The frequency of the antiresonance that occurs when the vibrations of the rubber foot resonance and the shaft resonance overlap is included between the frequency of the rubber foot resonance and the frequency of the shaft resonance.

In the example shown in FIG. 17, the frequency of the shaft resonance in which the drive shaft (25) resonates is lower than the frequency of the accumulator resonance in which the accumulator (40) resonates. The frequency of the antiresonance that occurs when the vibrations of the shaft resonance and the accumulator resonance overlap is included between the frequency of the shaft resonance and the frequency of the accumulator resonance.

In this embodiment, the frequency at which the vibration isolating member (14) resonates is referred to as the "first resonance frequency." A lower one of the frequency at which the drive shaft (25) resonates or the frequency at which the accumulator (40) resonates is referred to as the "second resonance frequency."

In the example shown in FIG. 17, the frequency at which the drive shaft (25) resonates is lower than the frequency at which the accumulator (40) resonates. Thus, the frequency at which the drive shaft (25) resonates is the second resonance frequency. If the frequency at which the accumulator (40) resonates is lower than the frequency at which the drive shaft (25) resonates, the frequency at which the accumulator (40) resonates is the second resonance frequency.

The antiresonance frequency at which antiresonance occurs in the accumulator (40) is included between the first resonance frequency and the second resonance frequency. In the example shown in FIG. 17, the frequency of the antiresonance that occurs when the vibrations of the rubber foot resonance and the shaft resonance overlap is the antiresonance frequency.

The 1n frequency is set to be equal to or higher than the first resonance frequency and equal to or lower than the antiresonance frequency at the maximum number of revolutions of the compressor body (11). The 3n frequency is set to be equal to or higher than the antiresonance frequency at the maximum number of revolutions of the compressor body (11).

Thus, the phase can be advanced by utilizing antiresonance so that the exciting force at the 3n frequency resulting from the rotation of the piston will not be transmitted to the accumulator (40) later than the exciting force at the 1n frequency.

The refrigeration apparatus (1) according to this embodiment is a cooling-only apparatus, and the rated capacity P [kW] of the refrigeration apparatus (1) and the volume V [cc] of the cylinder (51) satisfy the condition $P/V<1.9$.

It is thus possible to reduce the volume of the cylinder (51) per unit capacity in providing the compressor body (11) smaller in size and higher in speed.

The refrigeration apparatus (1) may be a cooling and heating machine configured to switch between cooling and heating. In this case, the rated capacity P [kW] of the refrigeration apparatus (1) during a cooling operation and the volume V [cc] of the cylinder (51) need to satisfy the condition $P/V<2.6$.

Advantages of Embodiment

According to a feature of this embodiment, a frequency that is one time the operation frequency n of the compressor body (11) and a frequency that is three times the operation frequency n of the compressor body (11) are referred to as the 1n frequency and the 3n frequency, respectively. The phase difference θ between the phase of the transfer function of the 1n frequency of the accumulator (40) and the phase of the transfer function of the 3n frequency of the accumulator (40) is set to be $-20° \geq \theta \geq -60°$ with respect to the peak of the 1n frequency where the phase lag is positive, at a maximum number of revolutions of the compressor body (11).

By this setting, the peak vibration at the 1n frequency and the peak vibration at the 3n frequency are shifted from each other without overlapping each other. The peak-to-peak value of the vibration of the accumulator (40) thus becomes smaller, so that it is possible to substantially prevent an increase in the vibration transmitted from the compressor body (11) to the accumulator (40).

According to a feature of this embodiment, the frequency at which the vibration isolating member (14) resonates is referred to as the first resonance frequency, and a lower one of the frequency at which the drive shaft (25) resonates or the frequency at which the accumulator (40) resonates is referred to as the second resonance frequency. The antiresonance frequency at which antiresonance occurs in the accumulator (40) is included between the first resonance frequency and the second resonance frequency. The 1n frequency is set to be equal to or higher than the first resonance frequency and equal to or lower than the antiresonance frequency at the maximum number of revolutions of the compressor body (11), and the 3n frequency is set to be equal to or higher than the antiresonance frequency at the maximum number of revolutions of the compressor body (11).

Thus, the phase can be advanced by utilizing antiresonance so that the exciting force at the 3n frequency resulting from the rotation of the piston (54) will not be transmitted to the accumulator (40) later than the exciting force at the 1n frequency.

According to a feature of this embodiment, it is possible to improve the compressor performance and keep the vibrations of the accumulator (40) from increasing in a high rotational speed range as well, by increasing the maximum number of revolutions of the compressor body (11) to 118 rps or more. The maximum number of revolutions of the compressor body (11) is preferably equal to or greater than 130 rps.

According to a feature of this embodiment, it is possible to keep the vibrations of the accumulator (40) from increasing in the case of a one-cylinder compressor body (11) as well, in which a problem of vibrations is particularly significant in a high rotational speed range.

According to a feature of this embodiment, a refrigeration apparatus includes the compressor unit (10) and the refrigerant circuit (la) through which the refrigerant compressed by the compressor unit (10) flows. It is therefore possible to provide the refrigeration apparatus including the compressor unit (10).

According to a feature of this embodiment, the refrigeration apparatus (1) is a cooling-only apparatus, and the rated capacity P [kW] of the refrigeration apparatus (1) and the volume V [cc] of the cylinder (51) satisfy the condition $P/V<1.9$. It is thus possible to reduce the volume of the cylinder (51) per unit capacity in providing the compressor body (11) smaller in size and higher in speed.

According to a feature of this embodiment, the refrigeration apparatus (1) is a cooling and heating machine configured to switch between cooling and heating, and the rated capacity P [kW] of the refrigeration apparatus (1) during the cooling operation and the volume V [cc] of the cylinder (51) satisfy the condition $P/V<2.6$. It is thus possible to reduce the volume of the cylinder (51) per unit capacity in providing the compressor body (11) smaller in size and higher in speed.

Other Embodiments

In this embodiment, an oscillating piston compressor including the piston (54) and the blade (57) integrated together has been described. However, a rolling piston rotary compressor including the piston (54) and the blade (57) separate from each other may be used.

While the embodiments have been described above, it will be understood that various changes in form and details can be made without departing from the spirit and scope of the claims. The embodiments described above may be appropriately combined or modified by replacing the elements thereof, as long as the functions of the subject matters of the present disclosure are not impaired. In addition, the expressions of "first," "second," "third," . . . , in the specification and claims are used to distinguish the terms to which these expressions are given, and do not limit the number and order of the terms.

As can be seen from the foregoing description, the present disclosure is useful for a compressor unit and a refrigeration apparatus.

The invention claimed is:

1. A compressor unit comprising:

a compressor body including a compression mechanism and a drive mechanism configured to drive the compression mechanism; and an accumulator connected to the compressor body, the compression mechanism including a cylinder, a piston configured to rotate eccentrically in the cylinder, and a blade partitioning an interior of a compression chamber of the cylinder into a low-pressure chamber and a high-pressure chamber, the drive mechanism including a drive shaft and a motor configured to rotate the drive shaft, a frequency that is one time an operation frequency n of the motor of the compressor body and a frequency that is three times the operation frequency n of the motor of the compressor body being a 1n frequency and a 3n frequency, respectively, a phase difference θ between a vibration transmission phase of the 1n frequency transferred to the accumulator from the compressor body and a vibration transmission phase of the 3n frequency transferred to the accumulator from the compressor body being $-20°\geq\theta\geq-60°$ with respect to a position shifted by 11° or more and 19° or less to a phase lead side from a peak of the 1n frequency where the phase lag is positive, at a maximum number of revolutions of the motor of the compressor body.

2. The compressor unit of claim 1 further comprising:

the compressor body including a casing and a vibration isolating member configured to support the casing, a frequency at which the vibration isolating member resonates being a first resonance frequency, a lower one of a frequency at which the drive shaft resonates or a frequency at which the accumulator resonates being a second resonance frequency, an antiresonance frequency at which antiresonance occurs in the accumulator being included between the first resonance frequency and the second resonance frequency, the 1n frequency being equal to or higher than the first resonance frequency and equal to or lower than the antiresonance frequency at the maximum number of revolutions of the motor of the compressor body, and the 3n frequency being equal to or higher than the antiresonance frequency at the maximum number of revolutions of the motor of the compressor body.

3. The compressor unit of claim 1, wherein the maximum number of revolutions of the motor of the compressor body is equal to or higher than 118 rps.

4. The compressor unit of claim 1, wherein the compressor body is a one-cylinder compressor including the single cylinder.

5. A refrigeration apparatus including the compressor unit of claim 1, the refrigeration apparatus further comprising:

a refrigerant circuit through which a refrigerant compressed by the compressor unit flows.

6. The refrigeration apparatus of claim 5, wherein the refrigeration apparatus is a cooling-only apparatus, and a rated capacity P in kW of the refrigeration apparatus and a volume V in cc of the cylinder satisfy $$P/V < 1.9.$$

7. The refrigeration apparatus of claim 5, wherein the refrigeration apparatus is a cooling and heating machine configured to switch between cooling and heating, and a rated capacity P in kW of the refrigeration apparatus during a cooling operation and a volume V in cc of the cylinder satisfy $$P/V < 2.6.$$

* * * * *